United States Patent [19]

Barmore

[11] Patent Number: 4,759,444

[45] Date of Patent: Jul. 26, 1988

[54] PACKAGING OF PLANT TISSUE

[75] Inventor: Charles R. Barmore, Moore, S.C.

[73] Assignee: W. R. Grace & Co., Duncan, S.C.

[21] Appl. No.: 45,095

[22] Filed: May 1, 1987

[51] Int. Cl.[4] ..... B65D 81/26

[52] U.S. Cl. ..... 206/521.1; 206/583; 426/124

[58] Field of Search ..... 206/45.33, 45.34, 566, 206/583, 521, 591, 521.1–521.3, 521.6–521.8; 426/106, 118, 124, 411, 415, 418

[56] References Cited

U.S. PATENT DOCUMENTS

| | | | |
|---|---|---|---|
| 2,501,570 | 3/1950 | Larsen . | |
| 2,681,142 | 6/1954 | Cohen . | |
| 2,837,208 | 6/1958 | Lingenfelter . | |
| 2,956,672 | 10/1960 | Kirkpatrick . | |
| 3,523,403 | 8/1970 | Collins . | |
| 4,494,650 | 1/1985 | Cullen | 206/45.34 |
| 4,542,822 | 9/1985 | Kennedy, Jr. et al. | 206/45.33 |
| 4,682,693 | 7/1987 | Moffitt et al. | 206/583 |
| 4,687,129 | 8/1987 | Cugley | 206/45.34 |

FOREIGN PATENT DOCUMENTS

| | | | |
|---|---|---|---|
| 2723175 | 11/1978 | Fed. Rep. of Germany | 206/566 |
| 0135796 | 11/1978 | Japan | 206/583 |
| 1109794 | 4/1968 | United Kingdom | 426/411 |

OTHER PUBLICATIONS

"Lenonet Bags", Bemis, Advert. in *The California Citrograph*, 2–1951, p. 172.

"Apple Packages", *Modern Packaging*, 4–1948, pp. 124–128.

*Primary Examiner*—Jimmy G. Foster

*Attorney, Agent, or Firm*—John J. Toney; William D. Lee, Jr.; Mark B. Quatt

[57] ABSTRACT

Plant tissue, such as fresh herbs, is packaged by suspending the tissue between sheets having no more than about 90% vapor impermeable surface area, and affixing the ends of the sheets to a container, or a gas flushed overwrap material.

10 Claims, 1 Drawing Sheet

PACKAGING OF PLANT TISSUE

BACKGROUND OF THE INVENTION

The present invention relates to the packaging of articles, especially food articles, and more particularly the packaging of plant tissue.

Plant tissue, and particularly products such as fresh herbs, will spoil or otherwise deteriorate, and lose much of their organoleptic quality over time.

Since plant tissue, in the form of fruits and vegetables, is often fragile and subject to abuse from shipping, storage, and the like, various packaging methods have been proposed to protect such products.

One method has been the hammock-type package, for example, as described in U.S. Pat. No. 2,501,570 issued to Larsen.

This reference discloses two sheets of plastic material suspended within an outer container of cardboard, corrugated board, plastic, etc. The packaged product, for example a fruit or vegetable, is contained within the plastic sheets. These sheets are ordinarily dust tight, but may be gas permeable or perforated.

Other hammock-type packs are disclosed in U.S. Pat. No. 2,956,672 (Kirkpatrick); U.S. Pat. No. 2,837,208 (Lingenfelter); and U.S. Pat. No. 2,681,142 (Cohen). These references generally teach the use of shrink films, plastic, cloth, or paper sheets which are used to wrap a fragile article such as light bulbs or electronic tubes. The wrapped article is suspended within a rigid container such as a cardboard box or transparent rigid plastic shell.

Also of interest is U.S. Pat. No. 3,523,403 which discloses an article placed between two transparent display panels mounted within a bifurcated cardboard shell. The article may be placed between the two film patches by bringing the two panels face-to-face.

One significant problem that has arisen in connection with packaging plant tissue such as fresh herbs is deterioration caused by contact of the tissue with moisture condensed on the interior wall of the packaging container. This is especially troublesome in connection with plastic films and other relatively solid, moisture and gas impermeable materials, whether transparent or opaque. Such moisture derives from transpiration of the tissue and condensation of this water vapor on the interior wall of the container. If the tissue is wrapped in close proximity or in contact with the interior wall of the wrapping material, this moisture will come in contact with the product and accelerate deterioration and reduction in quality of the article.

It is therefore an object of the present invention to provide a packaging system for plant tissue, such as fresh herbs, in which the shelflife of the tissue is extended.

It is also an object of the present invention to provide a packaging system in which condensed water derived from the plant tissue is kept out of contact with the plant product.

It is also an object of the present invention to provide a packaging system as described above, but substantially transparent to permit consumer inspection of the packaging product.

SUMMARY OF THE INVENTION

The invention in one aspect comprises a package useful for packaging plant tissue comprising a first tray having an outer edge; a first sheet, having no more than about 90% vapor impermeable surface area, attached to the first tray; a second tray having an outer edge; a second sheet, having no more than about 90% vapor impermeable surface area, attached to the second tray; said trays in contacting relationship to form an enclosure having the sheets suspended within the enclosure; and said sheets remote from the interior surfaces of said trays except at the edges of the trays.

Another aspect of the invention comprises a method of packaging plant tissue to reduce deterioration of the tissue by tissue-derived moisture, comprising placing a first vapor-permeable sheet on a first flanged tray; placing a second vapor-permeable sheet on a second flanged tray; sealing the sheets to the respective trays; placing the plant tissue on one sheet; and bringing the trays into contacting relationship at their edges to form an enclosure containing the plant tissue between the first and second sheets.

In still another aspect of the invention, a method of packaging plant tissue to reduce deterioration of the tissue by tissue-derived moisture comprises placing a vapor-permeable sheet on a first and second flanged tray, said trays connected by a hinge; sealing said sheet to said trays at the flanges thereof; placing plant tissue on said sheet; and closing said trays together along the hinge to form an enclosure containing the plant tissue within the sheet.

BRIEF DESCRIPTION OF THE DRAWINGS

Further details are given below with reference to the drawings, wherein like reference numerals refer to like parts throughout, and wherein.

DESCRIPTION OF THE PREFERRED EMBODIMENTS

Figure 1:
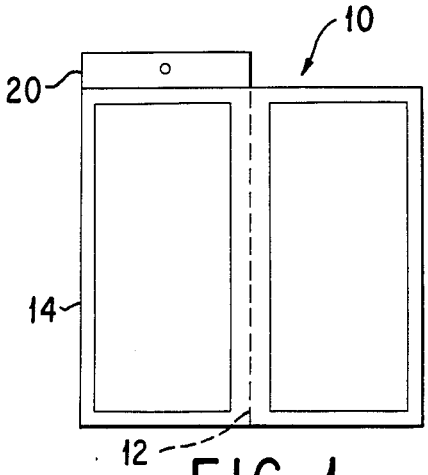
FIG. 1 is a schematic plan view of a preferred embodiment of a pair of rigid trays of the packaging in accordance with the invention.

Referring specifically to the drawings in FIG. 1, a schematic plan view of a preferred embodiment of the package of the invention is shown.

A pair of rigid trays 10 having a flange area 14 around the edge of each tray are connected to each other by hinge means 12.

Figure 2:
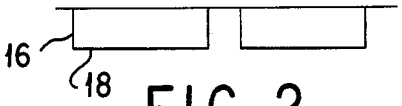
FIG. 2 is a cross section of the pair of rigid trays of FIG. 1.

As best seen in FIG. 2, each rigid tray 10 includes a side wall 16 and bottom member 18. For purposes of this invention, each rigid tray 10 must have a sufficient profile, i.e. a depth of side wall 16, such that when the package is completed as described further below, plant tissue contained within the trays will not impinge on interior surfaces of the side wall 16 or bottom member 18. Thus, the actual profile of specific embodiments of rigid tray 10 is depended to some extent on the nature of the plant tissue to be packaged. For certain plant product such as some of the fresh herbs, which lay relatively flat, the profile of rigid tray 10 can be relatively shallow and still function in accordance with this invention.

Optionally, a display tab 20 may be integrally incorporated into one of rigid trays 10, or else adhered to the tray by means well known in the art.

The pair of rigid trays 10 can be thermoformed by conventional means, and the hinge means 12 can be integrally formed with the pair of rigid trays 10 during the thermoforming process. Suitable thermoforming methods include a vacuum forming or plug-assist vacuum forming method. In a vacuum forming method, the first web is heated, for example, by a contact heater and a vacuum is applied beneath the web causing the web to be pushed by atmospheric pressure down into a preformed solid. In a plug-assist vacuum forming method, after the first or forming web has been heated and sealed across a mold cavity, upon the application of vacuum the forming web transfers to the mold surface.

Figure 3:
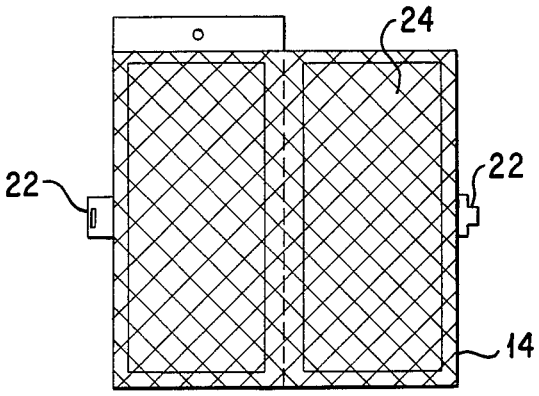
FIG. 3 is a schematic plan view of the pair of rigid trays of FIG. 1 onto which is placed a sheet having a mesh-like surface.

As shown in FIG. 3, a mesh-like sheet 24 is placed along the top of the pair of rigid trays 10 and affixed for example by heat sealing, in the flange areas 14 of rigid trays 10. Plant tissue 26, such as fresh herbs and the like, are then placed on the mesh-like sheet 24 preferably at a central location thereof.

Figure 4:
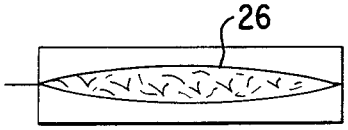
FIG. 4 is a side view of a closed package containing plant tissue in accordance with the invention.
Figure 5:
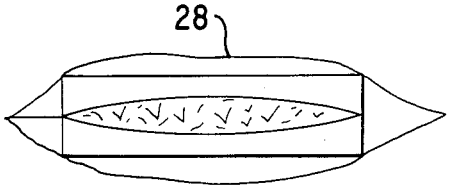
FIG. 5 is a side view of a package substantially similar to FIG. 4 and having an overwrap.

The pair of rigid trays carrying the sheet 24 and plant tissue 26 is then folded upon itself at the hinge means 12 to form a closed package as illustrated in FIGS. 4 and 5. The rigid container formed by the pair of trays 10 may be closed by suitable fastening means 22.

As seen in FIGS. 4 and 5, the plant tissue 26 is suspended within the container formed by the closed trays 10.

In a preferred embodiment, a netting and more preferably a thermoplastic netting is used for the sheet 24. Even more preferably a nylon netting is used. This material provides the strength needed to absorb impact and mechanical shock and abuse during shipping, storage, and marketing of the plant tissue. It also provides the pore area required to adequately allow water vapor to pass through the netting from the plant without a significant accumulation of condensed water on the interior surface of the netting. In this manner, condensate may form instead on the surfaces of the side wall and bottom member 16 and 18 respectively of the trays, but will not come in contact with the plant tissue 26 suspended within the container within sheet 24.

A suitable nylon netting has a pore area in the range of 90 to 95% of the surface area of the sheet. Put another way, no more than about 5% to 10% of the sheet comprises a solid or vapor impermeable surface.

Although some perforated and slit films, preferably thermoplastic films, may also be used as material for sheet 24, the pore area in relation to the total surface area of the sheet will determine the ability of the sheet to adequately vent water vapor respired by the plant tissue. It is preferred that over 10% and preferably over 15% of the material forming sheet 24 be pore area as opposed to no more than about 85% to 90% vapor impermeable surface area. As the relative pore area of the sheet decreases, the ability of the sheet to vent water vapor will decrease, and the likelihood and rate of deterioration of the plant tissue caused by condensate on the surface of the sheet 24 facing the plant tissue will increase. Thus, many conventional perforated films may be unsuitable for use in connection with the present invention.

Even more preferably, at least about 90% of the sheet material is pore area, i.e. no more than about 10% of the sheet is vapor impermeable surface area.

In order to enhance the shelflife of the plant tissue, and provide extra abuse protection for the total package, an overwrap 28 of preferably thermoplastic material and more preferably transparent thermoplastic material may be used to hermetically seal the container formed by rigid trays 10. The rigid trays 10 themselves are preferably of a transparent material, such that, with or without the overwrap 28, the plant tissue may be inspected at point of sale.

One advantage of closure means 22 is the ability provided to reseal the container formed by closed rigid trays 10 once the package is opened by the consumer.

Optionally, gas flushing may be used when overwrapping the container with overwrap 28 to further enhance the shelflife of the plant tissue. Gas flushing techniques in general are well known in the art.

The rigid trays 10, in addition to providing product protection, also permit a substantially automated packaging cycle for commercial production, and permit the application of labels to suitable surfaces of the tray. These labels can contain instruction for use, product and trademark data, and the like.

The invention may be further understood with respect to specific examples described below.

EXAMPLE 1

A thermoformed tray was made having in effect two rectangular rigid transparent tray sections of a thermoplastic material, and a flange area around each section, the two tray sections connected by an integral hinge. Therefore, the first and second tray sections, which can also be considered a tray and lid, were formed in one sheet or unit.

The tray sections were covered with a single sheet of netting attached to all four sides of the tray pair. Fresh herbs, comprising parsley and curly mustard, were placed on the netting, and the lid or second tray section was placed over the first tray section to close the trays together to form a container.

This container was overwrapped with a heat shrinkable thermoplastic film.

Visual inspection of the herbs contained in the package after 10 days demonstrated that the herbs were still fresh and green.

EXAMPLE 2

A pad was placed in the bottom of a #3A&E plastic tray, and herbs were placed on the pad within the tray. The tray was then placed inside nylon netting, and a second #3 tray was placed on top of and in alignment with the first tray. The entire package was overwrapped with a heat shrinkable thermoplastic film.

EXAMPLE 3

Herbs were placed on plastic netting and the netting was attached to the ends of a #3 tray. A second tray was placed on top of the first tray and the entire container overwrapped in heat shrinkable film.

EXAMPLE 4

Herbs were placed within a #3 plastic tray provided by A&E plastics, and a second similar tray was placed on top of the first tray. The container was overwrapped in heat shrinkable film and heat shrunk.

EXAMPLE 5

Plastic netting was placed over the top of each of two narrow long trays. Herbs were then placed on the netting of one of the trays, and the other tray was placed over the entire package. The container was then overwrapped on a trim-seal machine and the film heated to produce a tight package.

EXAMPLE 6

A form produced by removing all of the outside edges of a plastic tray, was placed in netting holding parsley and curly mustard. The package was overwrapped and provided a more economical means for producing a package wherein the plant tissue was protected from tissue derived moisture.

EXAMPLE 7

Fresh herbs were placed in a rigid clear tray, which in turn was wrapped with a nylon netting and overwrapped. Two seals were made to ensure a leak-tight package. The first seal was made at the edge of the overwrapped material. The second seal was made in the area in which the overwrapped material came in contact with the edge of the netting. The double sealing arrangement provided a better hermetic seal than a single seal.

EXAMPLE 8

Fresh herbs were placed inside nylon netting, and overwrapped in a 60-gauge film. The packages were hung to allow moisture, condensed on the inner walls of the overwrapped material, to flow to the bottom of the container. Six days later, the samples continued to look very fresh and green.

EXAMPLE 9

A package was made substantially similar to Example 8, but using 100-gauge D-955 film produced by the Cryovac Division of W.R. Grace & Co.

EXAMPLE 10

Parsley and curly mustard were placed on a foam tray, and netting was placed around the tray. The entire package was overwrapped in 100-gauge D-955 film, and the overwrap was gas flushed to create a pillow pack and to prevent contact between the herbs and the interior surface of the overwrapped film.

EXAMPLE 11

A bag was made from Cryovac® PY-110 film, a perforated film. This material has 110 micro-perforations (1 millimeter diameter each) per square inch. The bags (three bags were produced) had dimensions of 4 inches by 6 inches. Fresh spinach was packaged in each bag, the packages were sealed, and then these sealed packages were inserted in Cryovac® E-301 bags and the entire package sealed. The inner bag was suspended within the outer bag. The package was placed in an open retail case and kept at 31° F. for 24 hours, and were evaluated for the amount of condensate that had formed on the inner surface of the inner package. About twenty percent of the inner surface of the inner package exhibited condensate.

EXAMPLE 12

A bag was made from Cryovac® PY-85 film having 58 perforations per square inch (each perforation having a diameter of about one millimeter). Fresh spinach was packaged in the PY-85 film by the procedure described in Example 11. About thirty five percent of the inner surface of the inner package exhibited condensate.

EXAMPLE 13

A bag was made from Cryovac® D955 film in which 0.25 inch diameter holes were punched at a frequency of one hole per square inch of film. The finished package was prepared in accordance with Example 11, and about 50% to 60% of the inner surface of the inner bag had condensate.

The results of Examples 11–13 indicate that the package of Example 11 allowed more moisture to exit the inner package. This is inferentially shown by the relatively small amount of condensate (20%) on the inner surface of the inner bag. The packages of Examples 12 and 13, with decreasing pore density, had increasingly more undesirable condensate. Clearly, the pore density, or the amount of pore space in relation to the total surface area of the inner bag, helps determine the amount of undesirable condensate which will form on the inner bag. This in turn may have an effect on shelf-life of the packaged product, depending on the particular product.

"Vapor impermeable surface area" as used herein refers to the solid portion of a perforated, slit, or mesh-like film, as compared with the open or pore areas of such film. Although some measurable permeability for vapor such as water vapor can be demonstrated for some materials, the term is used here to denote the degree of impermeability which will foster development of condensate on the surface of the material. Clearly, solid material with 0% permeability is a fortiori included in the definition.

Although the present invention has been described in connection with preferred embodiment, it is to be understood that modifications may be utilized without departing from the principles and scope of the invention, as those skilled in the art will readily understand. Such modifications may be practiced within the scope of the following claims.

What is claimed is:

1. A method of packaging plant tissue to reduce deterioration of the tissue by tissue-derived moisture comprising:

(a) placing a single vapor-permeable sheet on a first and second flanged tray, said trays connected by a hinge;

(b) sealing said single sheet to said trays at the flanges thereof so that the sheet is substantially remote from the interior surfaces of the trays except at the flanges thereof;

(c) placing plant tissue on said sheet; and (d) closing said trays together along the hinge to form an enclosure containing the plant tissue within the sheet.

2. The method according to claim 1 further comprising overwrapping the trays, after forming the enclosure, with a thermoplastic film or bag.

3. The method according to claim 2 wherein the enclosure is gas flushed prior to the overwrapping step.

4. A package useful for packaging plant tissue comprising:

(a) a first rigid tray having a recessed interior surface, and a flange along the outer edge of said tray;

(b) a second rigid tray substantially similar to the first tray;

(c) an integral hinge connecting the first and second trays;

(d) a single vapor-permeable sheet attached to the flanges of the first and second trays;

(e) the trays, when closed about the hinge, forming an enclosure wherein the sheet is suspended within the enclosure, and substantially remote from the interior surfaces of the trays except at the flanges thereof, and wherein the sheet itself forms a vapor permeable enclosure.

5. A package according to claim 4 wherein the trays are transparent, thermoplastic trays.

6. A package according to claim 4 wherein the sheet is a net.

7. A package according to claim 4 wherein the sheet is a thermoplastic film having sufficient open areas therein to allow water vapor from plant tissue enclosed within the film to pass through the film.

8. A package according to claim 7 wherein the film substantially conforms to the aggregate shape of enclosed plant tissue.

9. A package according to claim 4 further comprising a thermoplastic film wrapped around said first and second rigid trays.

10. A package according to claim 4 further comprising closure means molded to corresponding edges of the first and second trays.

* * * * *